United States Patent [19]

Seeley

[11] 4,291,805

[45] Sep. 29, 1981

[54] ICE CREAM CONE TRAY

[75] Inventor: Leonard Seeley, Palatine, Ill.

[73] Assignee: Plastofilm Industries, Inc., Wheaton, Ill.

[21] Appl. No.: 173,143

[22] Filed: Jul. 28, 1980

[51] Int. Cl.[3] ..... B65D 1/34; B65D 85/78; A47G 19/00; B65D 1/36

[52] U.S. Cl. ..... 206/563; 206/564; 206/518; 229/1.5 H; 229/2.5 R; 220/23.8

[58] Field of Search ..... 206/563, 564, 578, 515; 229/1.5 H, 2.5 R; 220/23.8

[56] References Cited

U.S. PATENT DOCUMENTS

| | | | |
|---|---|---|---|
| 1,800,759 | 4/1931 | Shean | 229/1.5 H |
| 1,920,995 | 8/1933 | Legge | 229/1.5 H |
| 3,942,671 | 3/1976 | Florian | 206/564 |

*Primary Examiner*—William T. Dixson, Jr.
*Attorney, Agent, or Firm*—Howard H. Darbo

[57] ABSTRACT

A thermoformed plastic tray of unitary construction is provided for holding loaded ice cream cones while resting on a supporting surface without the tray tipping regardless of how few or how many cones up to capacity are in the tray. The tray has a plurality of sockets, e.g., three, for holding the cones, the sockets being defined by a rigid hemi-conical surface and a planar sidewall which gives imperceptibly upon insertion of the cone. The defined sockets hold the cones at a slight angle from the vertical position so that the cones extend upwardly and inwardly over the tray such that the center of gravity of the combined tray and ice cream cone or cones is always close to the center of gravity of the tray, thereby greatly increasing stability and permitting the tray to be quite small and light in weight.

9 Claims, 4 Drawing Figures

ICE CREAM CONE TRAY

BACKGROUND AND SUMMARY OF THE INVENTION

The present disclosure is directed toward an exceptionally stable yet small and lightweight tray for holding one or more ice cream cones without the tray and cone or cones tipping over.

Most ice cream cones, particularly so-called "sugar cones", have a conical shape and therefore once the ice cream is placed on the cone, the cone must always be either held or placed in a holder of some type. Some ice cream establishments simply pass the cones to the customer and let him or her worry about holding one or more cones while at the same time trying to find the correct change to pay for the cones. Other ice cream establishments have permanent trays mounted on the top of counters for temporarily holding the ice cream cones. There are various portable trays but they are not stable until more than one cone is placed in the tray, are inordinately large in order to maintain stability, or else consist of various pieces, such as two parallel shelves with coaxial openings therein and connecting legs. These latter trays are relatively expensive to manufacture, typically involving significant labor costs. Until now there has not been a small, easy to store, reliable and convenient to use tray which is both inexpensive and attractive.

The ice cream cone tray of the present invention is able to hold any number of cones up to its maximum design capacity without tipping over. The tray includes cone fitting sockets which angle the cones tray-inwardly, thereby keeping the center of gravity of the combined tray and ice cream cone or cones with ice cream thereon close to the center of gravity of the tray and greatly increasing stability as compared with other trays. The specially fitted sockets enable the tray to be extremely small for the number of cones it holds. The construction enables the tray to be extremely lightweight, inexpensive and easy to manufacture of thermoformed plastic having a unitary construction. In the preferred embodiment, the tray has three cone sockets and the sidewall structure is so designed that the tray is easy to grasp with one hand to carry the loaded cones safely while they rest snugly in their sockets, perhaps with the ice cream on the tops of the cones leading slightly against each other, thereby involving the loaded cones themselves in rendering the cones stable during movement of the tray and cones.

Each socket includes a relatively rigid curved recess in an inside wall segment, the curved recess having a hemi-conical surface with the vertex end toward the bottom of the tray. Opposite the hemi-conical surface of the curved recess is a reasonably strong but resilient planar sidewall. The sidewall gives imperceptibly when the cone is placed in the socket, pressing the cone gently against the conical surface. The interior wall segments are interconnected for greater structural strength. Means are provided for joining the sidewalls with the interconnected interior wall segments. In the preferred embodiment this is provided by horizontal base portions extending between the interior wall segments and sidewalls. The base of the tray rests on the counter or the table top. Also, in the preferred embodiment the sidewalls are connected by exterior wall segments to strengthen the sidewalls. Openings are provided in the exterior wall to permit lifting and holding the tray by a sidewall.

DESCRIPTION OF EXAMPLE EMBODYING BEST MODE OF THE INVENTION

Figure 1:
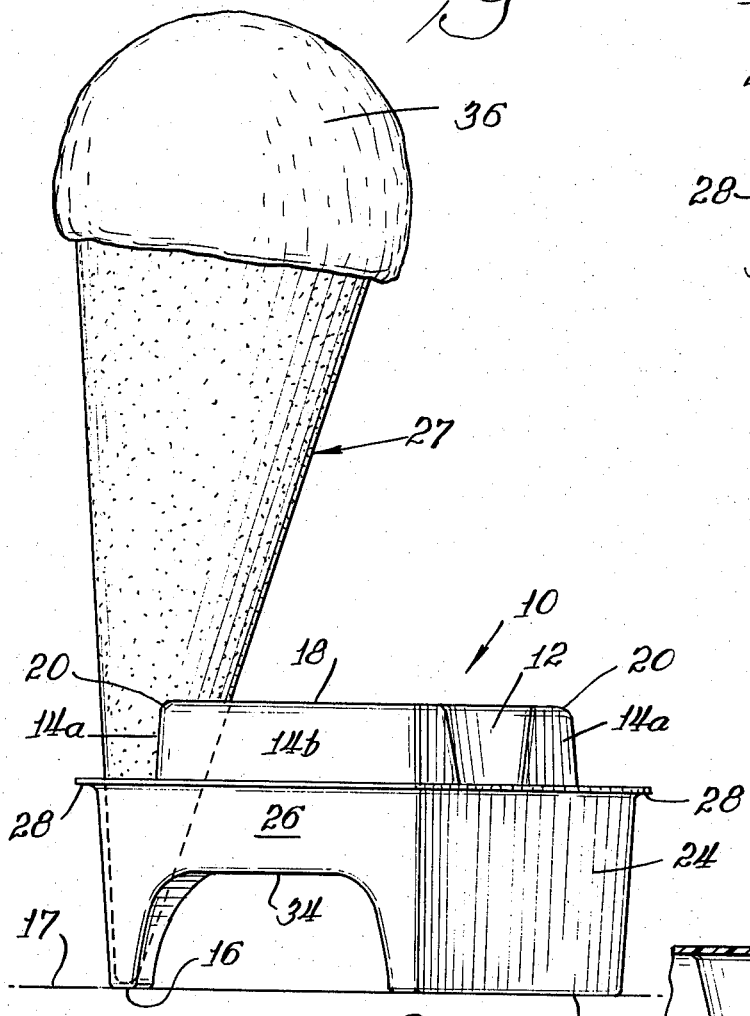
FIG. 1 is a side elevational view of the ice cream cone tray embodying the best mode of the invention and shown with one loaded ice cream cone held therein.
Figure 3:
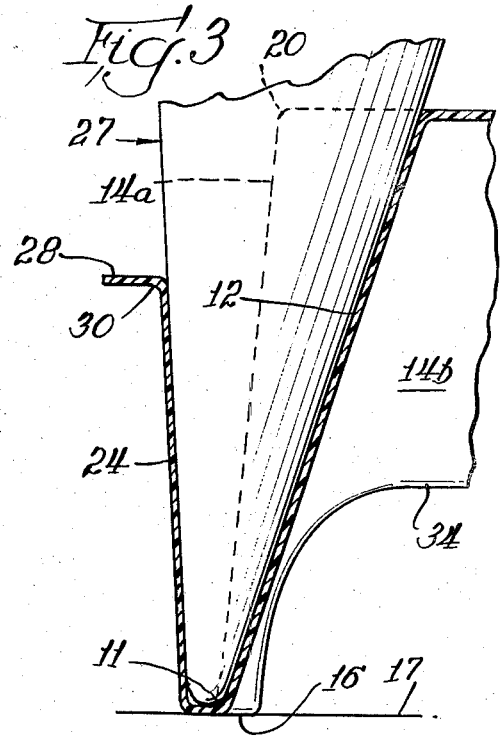
FIG. 3 is a sectional view taken at line 3—3 of FIG. 2 with an ice cream cone indicated in the socket.
Figure 2:
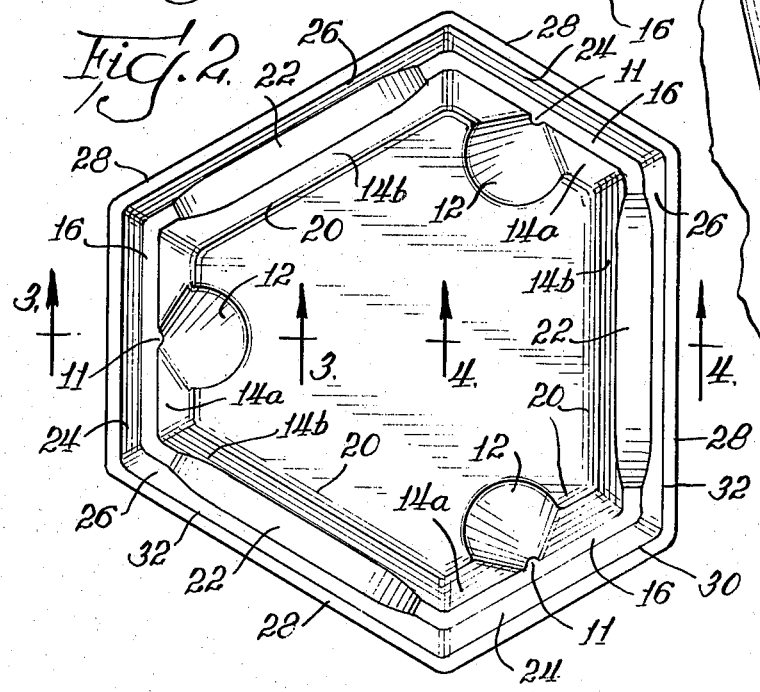
FIG. 2 is a top plan view of the tray, only, of FIG. 1.
Figure 4:
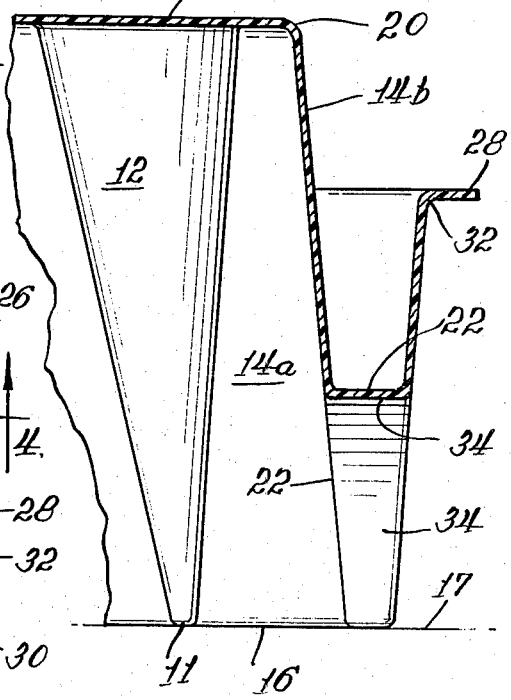
FIG. 4 is a sectional view taken at line 4—4 of FIG. 2.

As best seen in FIGS. 1 and 2, an ice cream cone tray 10 of unitary construction and manufactured of thermoformed plastic is provided. The tray 10 has a capacity for holding up to three ice cream cones but may be manufactured so as to hold a different number. In the example illustrated, a recess 12 is formed in each of three interior wall segments 14*a*. In this best mode of the invention, the curved recesses 12 provide hemi-conical surfaces closely conforming in size and shape to the cone intended to be received therein, each having a vertex end 11 at a horizontal base portion 16 extending from an interior wall segment 14*a*. The horizontal base portions 16 rest on a counter 17 and in the preferred embodiment extend not only from an interior wall segment 14*a*, but also partly from the adjacent interior wall segments 14*b* which have no curved recesses 12. These "wrap-around" base portions 16, together with interior wall segments 14*a*, 14*b* help to provide rigid and stable legs for the tray 10. The interior wall segments 14*b* are connected with the interior wall segments 14*a* to form a continuous inner wall around the center portion of the tray, thereby increasing the strength of the tray structure. A top 18 extends as a central plateau between interior wall segments 14*a*, 14*b* and merges into the top edges of the interior wall segments at ridge 20. The top 18 makes the tray better able to withstand a twisting force.

Connecting the horizontal base portions 16 about the perimeter of the interior wall segments 14*a*, 14*b* are bridges 22. Spaced tray-outwardly of interior wall segments 14*a*, 14*b* by the horizontal base portions 16 and bridges 22, are sidewalls 24 and exterior walls segments 26 which extend upwardly from the base portions 16 and bridges 22. The exterior wall segments 26 connect the sidewalls 24, giving the sidewalls 24 and the tray 10 added structural strength. Although the sidewalls, in conjunction with the hemi-conical surfaces, form the defined sockets, the exterior wall segments 26 provide continuity and strength permitting the sidewalls 24 to be constructed of much thinner and therefore, resilient material. Together, the exterior wall segments 26 and sidewalls 24 surround the interior wall segments 14*a*, 14*b*. A lip 28 extends tray-outwardly from the top edges 30, 32 of the sidewalls 24 and exterior wall segments 26 respectively to further increase the strength of the tray and improve appearance.

Each exterior wall segment 26 has a bottom edge 34 which is spaced above the counter 17, the tray resting on horizontal base portions 16. A bridge 22 is disposed between each exterior wall segment 26 and interior wall segment 14*b*, following bottom edge 34. The bottom edges 34 are archways defining openings through which one or two fingers may be inserted to grasp the tray. The exterior wall segment 26, bridge 22, and lip 28 thus all serve together as a handle with which the tray may be lifted and carried. The tray is small enough that it may alternatively be grasped in one hand around several of the exterior wall segments 26 and sidewalls 24.

The interior wall segments 14*a*, 14*b*, exterior wall segments 26 and sidewalls 24 all are disposed at a slight angle from vertical. The sidewalls 24 and exterior wall segments 26 extend upwardly and slightly tray-outwardly and the interior wall segments 14*a*, 14*b* and curved recesses 12 extend upwardly and slightly tray-inwardly. Such construction permits stacking a plurality of trays 10 in a nesting manner for easy and compact storage. When the tray is of unitary plastic construction, these small angles also provide the drafts required in the thermoforming process.

It is the sidewalls 24 in combination with the hemi-conical surfaces of the curved recesses 12 which together form the uniquely defined sockets for securely but releasably holding ice cream cones 27 with scoops of ice cream 36 thereon in a stable manner such that the tray will not tip, whether one, two or three cones are placed in the tray. When a cone 27 is lowered between a curved recess 12 and sidewall 24, it becomes securely lodged therebetween. Such a construction holds the cone in snug contact with the conical surface of the socket with a minimum of surface contact with the sidewall 24. As the cone 27 is inserted into the defined socket, the sidewall 24 is urged tray-outwardly only slightly to provide a gentle resiliant pressure inwardly directed against the cone. The fit is tight enough and the hemi-conical surface closely conforms to the shape of the engaging surface of the cone so that the cone is securely held in place. The sidewall 24 extends upwardly and slightly tray-outwardly and the conical recess 12 extends upwardly from the vertex end 11 and tray-inwardly enough so that the axis of an ice cream cone in the socket is inclined tray-inwardly toward the center of the tray, as opposed to a true vertical position.

In the embodiment illustrated, the defined sockets hold the ice cream cones at an angle approximately ten to twelve degrees from vertical. The degree of inward inclination is not critical and represents a compromise optimum taking into account tray size, security of the ice cream on the tops of the cones and the stability of the loaded cone and cones in the tray. However, since the cone 27 is in contact with the tray 10 around only approximately one-half of its circumference, it does not become stuck in the socket and may be easily lifted out of the tray without difficulty or damage to the cone. If a conical surface alone rather than the combination hemi-conical surface and sidewall 24 were used for the socket, the cone 27 would either be loose in the socket and wobble or else fit so tightly as to be hard to extract from the tray without damaging the cone. This inclination is enough to locate the center of gravity of each loaded ice cream cone 27 considerably tray-inwardly even when the ice cream exposed above the cone is lopsided tray-outwardly.

Each loaded cone leans inwardly and is supported against falling by the full width of the tray beneath it. Thus, it is not only possible to carry the cones at or near the perimeter of the tray without extra added weight and structure being placed tray-outwardly of the sockets, but the desirable arrangement enhances the stability of the loaded tray.

In the tray shown, having three defined sockets for holding cones at an inclination tray-inwardly from vertical, the bodies of ice cream on top of each cone may lightly engage each other. This "tepee-like" structure further serves to increase stability of the tray and load, both while the cones are being loaded into the tray and resting on the counter during sale and also during carrying of the tray and cones. At the same time, because each socket is set inwardly from what would be the vertices of a triangular, three-cone tray, substantial lateral support for each cone is also provided. While trays having a different number of defined sockets are of course possible, it is believed that trays with three sockets are most desirable.

As stated, the manner in which the cones 27 are held and the construction of the defined sockets enables the sockets to be placed at the perimeter of the tray 10, thereby permitting the tray to be much smaller than would otherwise be possible, as extra structure and weight need not be placed tray-outwardly of the socket in order to prevent the tray from tipping when, for example, only one cone has been loaded into the tray. The resulting smaller tray structure saves material and makes the tray less expensive to produce. The small size also makes the tray more convenient for storage and may be reused by the consumer at home. The unique design with sockets defined by sidewall 24 and curved recess 12 also permits the tray to be of unitary construction, thereby further reducing cost.

Most importantly, a tray is provided for firmly and safely holding ice cream cones during loading of the tray and during transport of the ice cream cones while also permitting easy removal of the cones, all in a material and space efficient manner utilizing the weight of the loaded cone or cones themselves to enhance the stability of the loaded tray.

What is claimed is:

1. A unitary thermoformed plastic ice cream cone tray capable of securely and releasably holding at least three ice cream cones, said tray comprising at least three generally vertical but tray-inwardly inclined interior wall segments, a hemi-conical recess in each said interior wall segments, a generally vertical but tray-outwardly inclined sidewall opposite and in spaced relation to each said interior wall segment and means for joining the bottom edges of the respective opposed sidewalls and interior wall segments whereby each said recess and opposed sidewall together define a socket adapted to receive an ice cream cone, the inclinations of said sidewall forming each socket being such that the axis of said socket is inclined tray-inwardly and said tray further including a second set of interior wall segments each connecting adjoining first-mentioned interior wall segments to provide a continuous inner wall.

2. An ice cream cone tray in accordance with claim 1 and including a horizontal plateau wall connected with and spanning the area defined by the top edges of the totality of interior wall segments.

3. An ice cream cone tray in accordance with claim 2 wherein the axis of each socket is inclined tray-inwardly approximately 10–12 degrees from vertical.

4. An ice cream cone tray in accordance with claim 1 wherein the axis of each socket is inclined tray-inwardly at such an angle that the center of gravity of a loaded ice cream cone disposed in said socket is tray-inwardly of the ice cream cone.

5. An ice cream cone tray in accordance with claim 1 wherein said sidewall is resilient and is so located with respect to said recesses that a portion thereof is displaced tray-outwardly upon insertion of a cone into said defined socket.

6. An ice cream cone tray in accordance with claim 5 which is unitary and composed of thermoformed plastic material and wherein said sidewalls, exterior wall segments and interior wall segments are disposed at an angle from vertical such as to permit a plurality of said trays to be stacked in a nesting manner.

7. An ice cream cone tray having a capacity for securely and releasably holding at least three ice cream cones, said tray comprising:

a. at least three connecting interior wall segments;

b. a curved recess in at least three of said interior wall segments, said curved recesses being in the shape of a hemi-conical surface;

c. a horizontal base portion extending tray-outwardly from each of said interior wall segments having a recess therein;

d. a resilient sidewall extending upwardly from each said horizontal base portion and opposite and in spaced relation to said recess; and e. exterior wall segments connecting said resilient sidewalls, the arrangement being such that each sidewall and its opposite hemi-conical surface together define a socket to receive an ice cream loaded cone and support the cone at a tray-inwardly angle of approximately 10–12 degrees from vertical.

8. A unitary thermoformed plastic ice cream cone tray comprising hexagonal generally dish-shaped outer portion and a downwardly opening dish-shaped inner portion disposed within said outer portion with the sidewalls thereof spaced from the sidewalls of said outer portion, said inner portion being substantially equilateral triangular in horizontal section with the vertices cut back to provide short cone-supporting wall segments, each said wall segment having a hemi-conical recess therein diverging upwardly from the lower edge of said wall segment, and defining with the contiguous portion of said sidewall of said outer portion of said tray a socket for snugly receiving an ice cream cone therein, said sidewall of said outer portion being inclined tray-outwardly and said recess being formed so that the axis of a cone in said socket is inclined tray-inwardly over said tray, and bridging structure extending between and rigidly connecting contiguous respective portions of the bottom edges of the sidewalls of said inner and outer portions of said tray.

9. An ice cream cone tray in accordance with claim 8 wherein said bridging structure at said short cone-supporting wall segments extends horizontally to provide tray-supporting surfaces and said bridging structure extending between said tray-supporting surfaces is arched to provide openings for entry of the fingers of a person to grasp and lift the tray.

* * * * *